US007474287B2

(12) United States Patent
Wu et al.

(10) Patent No.: US 7,474,287 B2
(45) Date of Patent: Jan. 6, 2009

(54) LIGHT EMITTING DEVICE

(75) Inventors: Enboa Wu, Irvine, CA (US); Ming Lu, Sijhih (TW); Geoffrey Wan Tai Shuy, New Territories (CN)

(73) Assignee: Hong Kong Applied Science and Technology, New Territories, Hong Kong SAR (HK)

( * ) Notice: Subject to any disclaimer, the term of this patent is extended or adjusted under 35 U.S.C. 154(b) by 302 days.

(21) Appl. No.: 11/318,314

(22) Filed: Dec. 23, 2005

(65) Prior Publication Data

US 2007/0146256 A1 Jun. 28, 2007

(51) Int. Cl.
*G09G 3/32* (2006.01)

(52) U.S. Cl. ..... 345/82; 345/46

(58) Field of Classification Search ..... 345/44, 345/46, 82–84, 211, 39, 48, 204; 257/13, 257/88, 94

See application file for complete search history.

(56) References Cited

U.S. PATENT DOCUMENTS

| | | | | |
|---|---|---|---|---|
| 4,271,408 | A * | 6/1981 | Teshima et al. | 345/83 |
| 4,887,074 | A * | 12/1989 | Simon et al. | 345/82 |
| 5,998,925 | A | 12/1999 | Shimizu et al. | |
| 6,307,218 | B1 | 10/2001 | Steigerwald et al. | |
| 6,445,007 | B1 * | 9/2002 | Wu et al. | 257/80 |
| 6,469,453 | B2 | 10/2002 | Tajika | |
| 6,563,139 | B2 | 5/2003 | Hen | |
| 6,963,085 | B2 | 11/2005 | Chou | |
| 7,106,010 | B2 * | 9/2006 | Liao et al. | 315/312 |
| 7,180,487 | B2 * | 2/2007 | Kamikawa et al. | 345/83 |
| 7,230,222 | B2 | 6/2007 | Cheng et al. | |
| 7,293,907 | B2 | 11/2007 | Kim et al. | |
| 7,381,995 | B2 | 6/2008 | Tain et al. | |
| 7,385,653 | B2 | 6/2008 | Kim et al. | |
| 2002/0047556 | A1 | 4/2002 | Tajika | |
| 2004/0065893 | A1 * | 4/2004 | Otsuka et al. | 257/99 |

FOREIGN PATENT DOCUMENTS

| | | |
|---|---|---|
| JP | 55123182 | 9/1980 |
| JP | 09081077 | 3/1997 |
| JP | 2002-107692 | 4/2002 |

OTHER PUBLICATIONS

Craford, M. George, Holonyak, Nick, and Kish, Frederiek, "In Pursuit of the Ultimate Lamp", Scientific American 284, 62, Feb. 2001.
Office Action issued by the United States Patent and Trademark Office for U.S. Appl. No. 11/317,937 dated Jun. 26, 2008.
Office Action issued by the United States Patent and Trademark Office for U.S. Appl. No. 11/317,281 dated May 28, 2008.
Office Action issued by the United States Patent and Trademark Office for U.S. Appl. No. 11/317,281 dated Oct. 19, 2007.

* cited by examiner

*Primary Examiner*—Regina Liang
(74) *Attorney, Agent, or Firm*—Schlee IP International, P.C.; Alexander R. Schlee

(57) ABSTRACT

A light emitting device includes a time delay mechanism in electrical connection with a power source for time shifting at least a portion of a power signal outputted by the power source and a plurality of light emitting units formed by at least a light emitting diode (LED)structure, each light emitting unit being driven alternately and sequentially using the power source and the time delay mechanism.

16 Claims, 5 Drawing Sheets

LIGHT EMITTING DEVICE

FIELD OF THE INVENTION

The present application relates to light emitting devices using semiconductor light emitting diodes.

BACKGROUND OF THE INVENTION

Various improvements have been proposed to enhance the performance of light emitting devices using semiconductor light emitting diodes (LED). For example, U.S. Pat. No. 6,307,218, entitled "Electrode structures for light emitting devices" and assigned to Lumileds Lighting, U.S., LLC, discloses finger type electrode layouts to solve the current crowding issue in semiconductor LEDs. U.S. Pat. No. 5,998,925, entitled "Light emitting device having a nitride compound semiconductor and a phosphor containing a garnet fluorescent material" and filed by Shimizu et al on Jul. 29, 1997, discloses generation of white light through phosphor conversion of a portion of the primary radiation emission of the an LED device to longer wavelengths.

Nevertheless, further improvements may still be desirable. For example, few conventional designs have considered the heat dissipation and energy consumption issues. These issues may become more noticeable if the LEDs have a relatively large size.

In addition, in order to achieve good current spreading in the semiconductor layers and to avoid over-heating in partial areas caused by possible relatively high current in such areas, the design of the '218 patent may need to have a relatively compact electrode layout design. As a result, the opening area for light emission may be unnecessarily small, which may not be desirable, either.

OBJECT OF THE INVENTION

Therefore, it is an object of the present invention to provide a light emitting device with improved heat dissipation or energy consumption characters, or at least provide the public with a useful choice.

SUMMARY OF THE INVENTION

According to an aspect of the present invention, a light emitting device includes a time delay mechanism in electrical connection with a power source for time shifting at least a portion of a power signal outputted by the power source and a plurality of light emitting units formed by at least a light emitting diode (LED)structure, each light emitting unit being driven alternately and sequentially using the power source and the time delay mechanism.

In one embodiment the power source is an alternate current power source.

In another embodiment a rectifying circuit is electrically connected between at least one of the light emitting units and one of the power source and the time delay mechanism.

In another embodiment the time delay mechanism includes a phase shifter for shifting the phase of the power signal by a predetermined amount.

In another embodiment the power source outputs a plurality of periodic discontinuous pulses.

In another embodiment the output of the power source has a frequency of at least 20 Hz.

In one embodiment the plurality of light emitting units are formed by a signal LED, and the LED includes a top surface with a light emitting region;

a heterojunction within the device structure, the heterojunction comprising a p-type and an n-type semiconductor layer;

a plurality of electrodes positioned on the top surface, each being electrically connected to one of the p-type and n-type semiconductor layers, wherein at least a first and a second of the plurality of electrodes are connected to a same type semiconductor layer and are physically separated from each other;

at least a first and a second heterojunction regions within the heterojunction, each being respectively defined between one of the first and second electrodes and one of the other electrodes connected to the other type semiconductor layer, wherein each heterojunction region forms one of the light emitting units.

In another embodiment the first and second electrodes are diametrically opposed.

In another embodiment the first and second electrodes are located at the corners of the top surface.

In another embodiment the light emitting device has an optional transparent or semi-transparent electrode layer forming the top surface for improving current spreading.

In another embodiment the electrode layer is made of a material selected from the group consisting of Indium Tin Oxide, Indium Zinc Oxide, and Zinc Oxide.

In another embodiment each light emitting unit is formed by a single individual LED of a respective wavelength, wherein the plurality of LEDs are placed in close proximity to each other such that a combination of the lights emitted by each LED is generated after a mixing length from the plurality of LEDs, and-whereby said combination of the lights of the first and second wavelengths exhibits a predetermined color in the human vision.

In another embodiment the light emitting device has control mechanism for controlling at least a character of one of the plurality of LEDs for altering the color of said combination of lights exhibited in the human vision, the control mechanism may include an adjustable resistor for controlling the voltage amplitude applied to the at least one of the plurality of LEDs, and/or may includes means for controlling the frequency of the power signals applied to the at least one of the plurality of LEDs.

In another embodiment at least two of the LEDs emit lights of different wavelengths.

In another embodiment a phosphor materials coating is used for at least one of the LEDs for altering the wavelength of its lights.

In another embodiment the light emitting device has a diffuser for diffusing the lights of at least one of the plurality of LEDs so as to reduce said mixing length.

Other aspects and advantages of the invention will become apparent from the following detailed description, taken in conjunction with the accompanying drawings, which description illustrates by way of example the principles of the invention.

DETAILED DESCRIPTION

Figure 1:
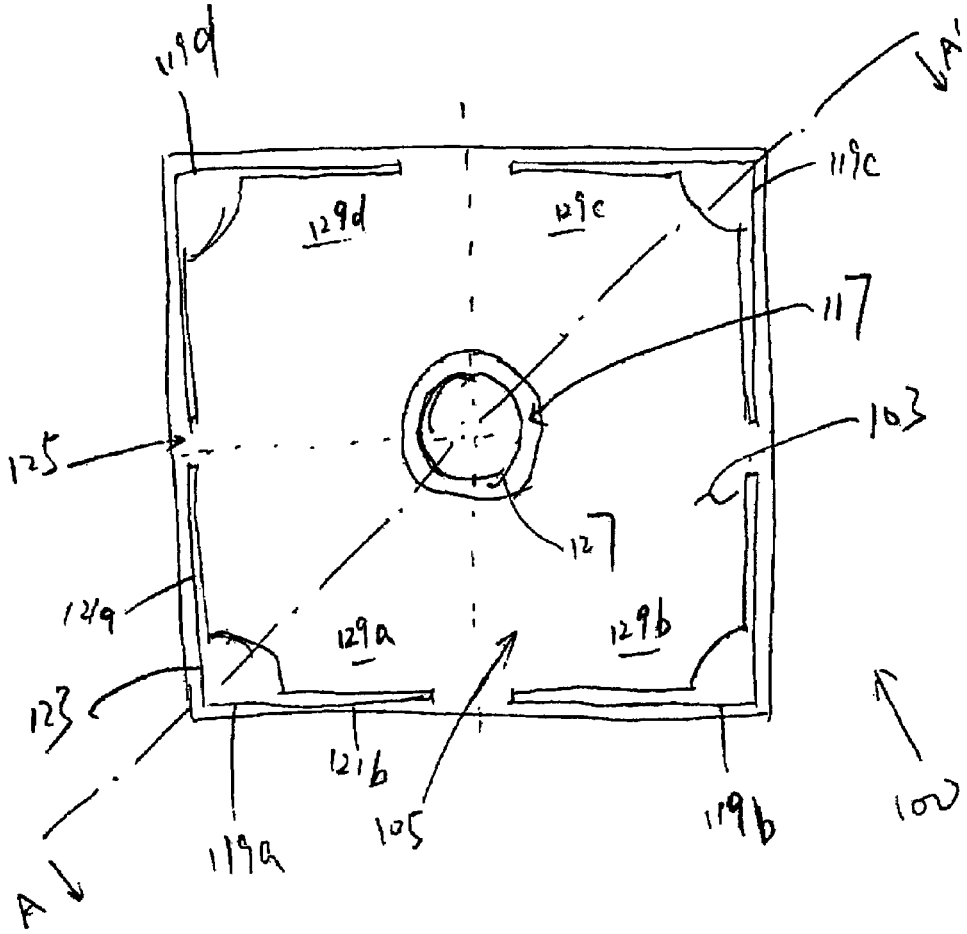
FIG. 1 is a top plan view of an exemplary light emitting device according to an embodiment of the present invention.
Figure 2:
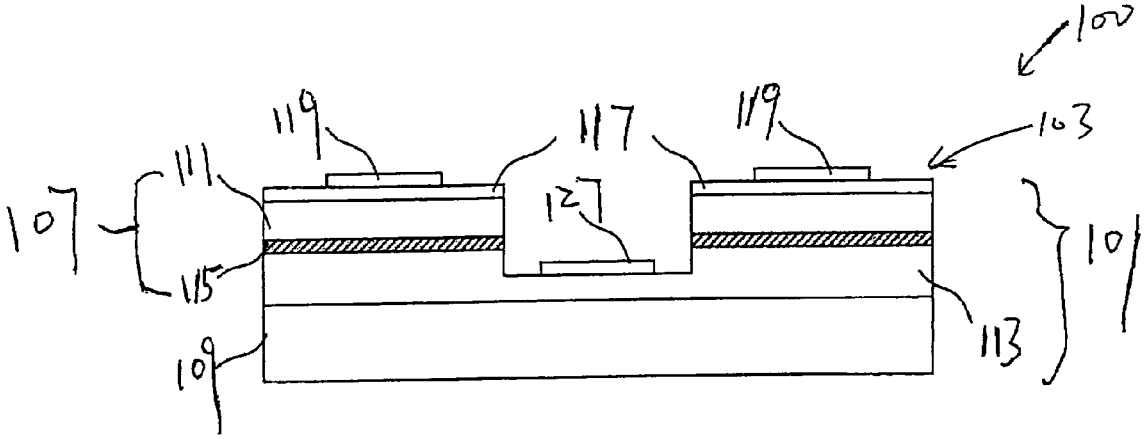
FIG. 2 is a cross section view of the light emitting device of-FIG. 1 along line A-A'.

As shown in FIGS. 1 and 2, an exemplary light emitting embodiment 100 of the present invention firstly includes a single light emitting diode (LED) structure 101, having a top surface 103 in a generally square shape in the exemplary embodiment with a light emitting region 105. The LED 101 includes an active region 107 on an optional substrate 109. The active region 107, e.g. a heterojunction, has a p-type and an n-type semiconductor layer 111, 113, which form an active layer 115, i.e., a p-n injection, between the p- and n-type semiconductor layers 111, 113.

A transparent electrode layer 119, made of materials selected from a group of, e.g., Indium Tin Oxide, Indium Zinc Oxide, or Zinc Oxide, is attached atop the p-type semiconductor layer 111 such that it defines the top surface of the LED. The transparent electrode layer 117 functions as a current spreading layer and a transparency electrode as could be generally understood in the art. Due to its transparency, lights can be emitted from the top surface of the LED. Thereby, the light emitting region 105 is defined by uncovered regions of the transparent electrode layer 117.

Four p-electrodes 119*a-d* are attached to the transparent electrode layer 117 at its four corners and are electrically connected thereto for providing stable electrical contacts between the transparent electrode layer and external electrical contacts. Each p-electrode 119*a-d* has a pair of thin metal lines 121*a*, 121*b* extending from a metal pad or bump 123 at one of the corners substantially perpendicular to each other towards the other two adjacent corners. The pad 123 has a sector shape in the exemplary embodiment and a substantially enlarged size as compared to the finger-type lines 121*a*, 121*b* for ensuring good electrical connections to external electrical circuits (not shown in FIGS. 1 and 2). A gap 125 is created between every-two adjacent p-electrodes such that the p-electrodes 119*a-d* are physically separated from each other.

Part of the active region 107 and the transparent electrode layer 117 are etched away to expose part of the n-type semiconductor layer such that an n-electrode 127, electrically connected to the n-type semiconductor layer 113, can be electrically isolated from the p-electrodes 119*a-d*, transparent electrode layer 117 and p-type semiconductor layer 111. The etched part has a substantially circular shape and is positioned in the center of the LED structure when viewed from the top as shown in FIG. 1.

As known to the person skilled in the art, such p and n-electrode layouts may assist overcoming the current crowding effect.

In addition, four heterojunction regions 129*a-d* within the heterojunction are virtually defined between the respective p-electrodes 119*a-d* and the n-electrode 127, which will be discussed in further details. The heterojunction regions 129*a-d* are defined such that each heterojunction region 129*a-d* can be activated so as to emit lights when a certain amount of voltage is applied to the respective p-electrode and n-electrode. As could be appreciated, the dotted lines in FIG. 1 virtually defining the heterojunction regions 129*a-d* are merely for illustration purpose, and an ordinarily skilled person in the art would understand that the heterojunction regions 129*a-d* may exhibit a different shape.

Figure 3:
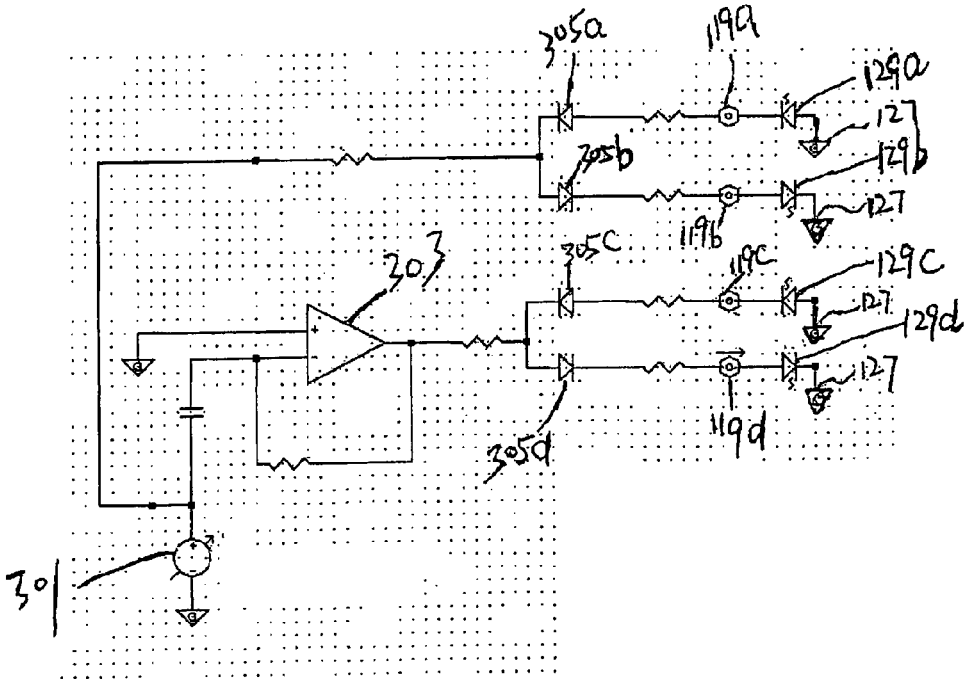
FIG. 3 is a simplified exemplary electrical circuit diagram illustrating the light emitting device of FIGS. 1 and 2 being in use.
Figure 4:
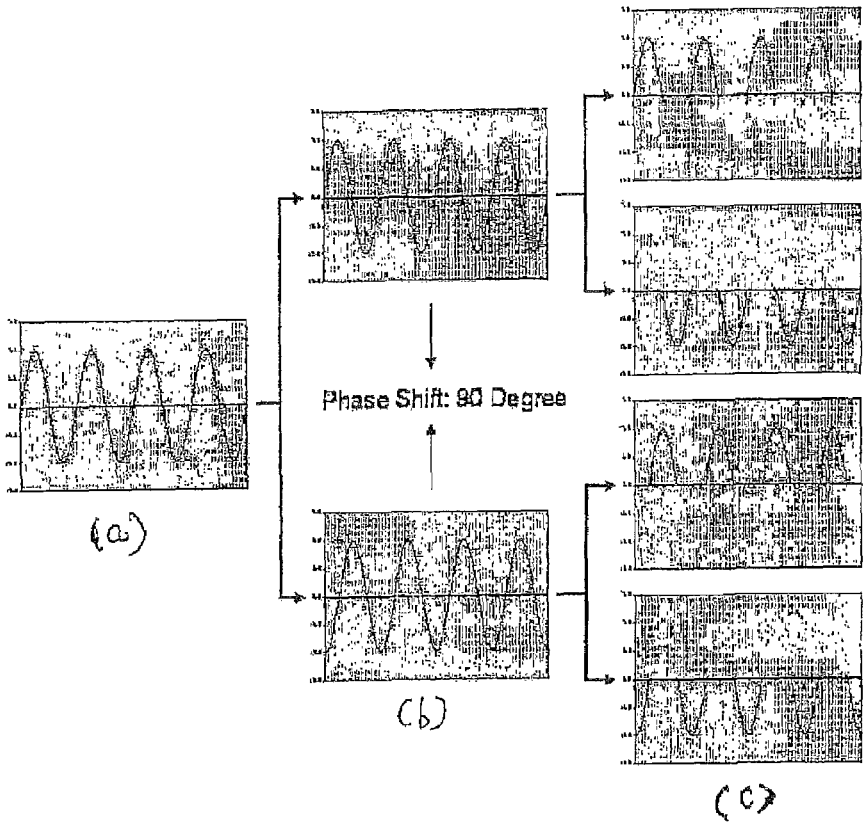
FIGS. 4*a-c* illustrate the electrical signals applied to the different parts of the light emitting device of FIGS. 1 and 2 when used in the electrical circuit of FIG. 3.

FIG. 3 illustrates the use of an alternating power source 301 for driving the LED structure 100. The output of power source 301 as shown in FIG. 4*a* is first shifted by 90 degrees by a phase shifter 303. Both the AC output and shifted power signals, illustrated by FIG. 4*b*, are subsequently rectified by a plurality of rectifying diodes 305*a-d* before being supplied to the four electrodes 119*a-d* and further the four heterojunction regions 129*a-d*, each of which is simplified as a light emitting diode unit connected to its respective electrodes. Further, n-electrode 127 is connected to ground.

The positive phases of the output of the power source, voltage is applied between p-electrodes 119*a*, and n-electrode 127; during its negative phases, voltage is applied between p-electrodes 119*b*, and n-electrode 127. Further, during the positive phases of the shifted signals, voltage is applied between p-electrodes 119*c*, and n-electrode 127; during its negative phases, voltage is applied between p-electrodes 119*d*, and n-electrode 127.

Figure 5:
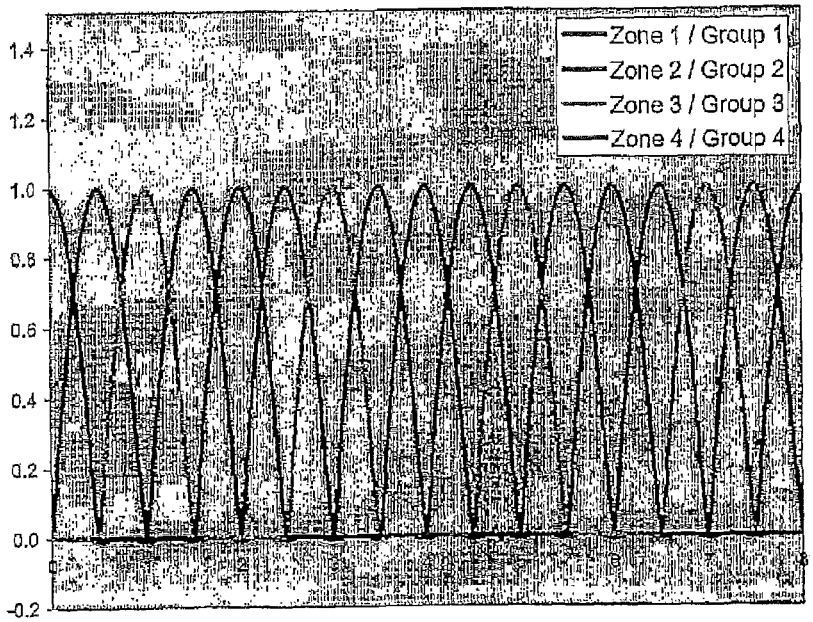
FIG. 5 illustrates driving of different parts of the light emitting device of FIGS. 1 and 2 when used in the electrical circuit of FIG. 3.

Thereby, heterojunction regions 129*a*, 129*c* and 129*b*, 129*d* are alternately and at least partially driven to emit lights in the time domain as illustrated in FIG. 5. Due to the persistence of human vision, when the frequency of the AC power signals is sufficiently high, for example, higher than 20 Hz, the discontinuoucy or variance in the light becomes innoticeable in the human vision.

It can be seen how the shifting the phase of the AC power signals by a predetermined degree allows the single power source to alternately drive more than one LED in the time domain. The phase shifting in the above described exemplary embodiment causes a delay in the time domain such that the peaks of the shifted signals do not overlap with the peaks of the original signals. Thereby, both the original and shifted power signals can be used to alternately drive different light emitting units.

It can be generally understood that activation or driving of the heterojunction regions 129*a-d* at least partially depends upon the magnitude of the current applied therethrough. For example, when a relatively high current is applied, a relatively large area of each heterojunction regions can be activated to emit lights, and vice versa.

It should be clear to an ordinarily skilled person in the art that the above-described embodiments should achieve lower energy consumptions by alternately driving various heterojunction regions of an LED structure in the time domain. Since each heterojunction region of the LED structure now works in an on-and-off status, heat dissipation can be improved as well.

Furthermore, unnecessary coverage of the transparent electrode layer by the p and n-electrode layout can be reduced in the present invention as compared to conventional finger-type electrode layout. This is because in the exemplary embodiment of FIGS. 1 and 2, the over heating issue is solved by alternately driving different heterojunction regions, and therefore the exemplary embodiment of FIGS. 1 and 2 may not need compact electrode layout to achieve even current spreading, as required in the conventional designs. As a result, the exemplary embodiment of the present invention may provide a relatively large light emission area.

Figure 6:
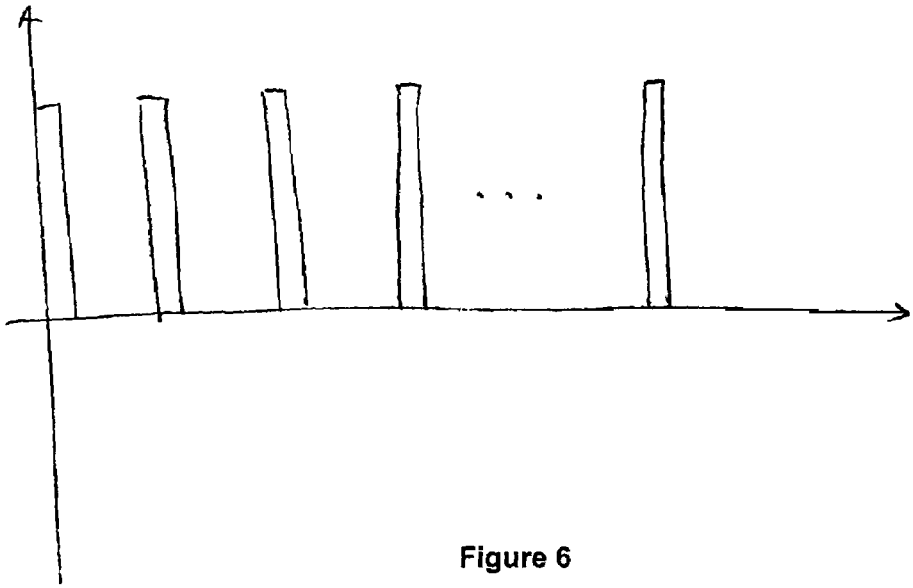
FIG. 6 illustrates another type of power signals suitable for driving the light emitting device of FIGS. 1 and 2.

Various type of power signals can be used. For example, FIG. 6 illustrates a different type of output of the power source useful in the light emitting device of FIGS. 1 and 2, having a plurality of periodic discontinuous pulses to be sequentially and alternately applied to the p-electrodes 129*a*, 129*c* and 129*b*, 129*d* in the time domain.

Figure 7:
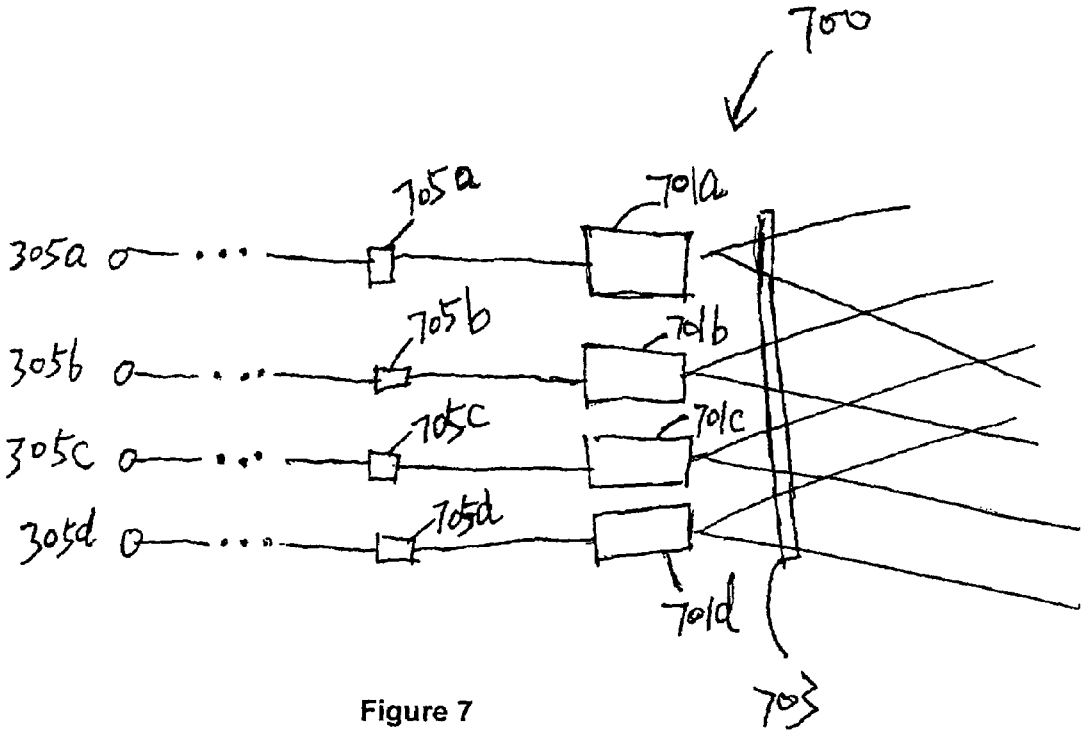
FIG. 7 illustrates the simplified structure of another exemplary light emitting device according to an embodiment of the present invention.

FIG. 7 illustrates another exemplary light emitting device 700 suitable for use in the circuit of FIG. 3. The light emitting device 700 has a plurality of light emitting diodes (LED) 701*a-d* emitting different colors of lights respectively, for exampe, blue, amber, green and so on. The LEDs 701*a-d* are placed in close proximity such that the different colored lights can combine to produce a light of a different color in the human vision after a mixing length from the LEDs as could be generally understood in the art. A diffuser 703 can be placed on the light path of the lights from the LEDs for reducing the mixing length. Further, each LED 701*a-d* has an input 705*a-d* for electrically connecting to the rectifying diodes 305*a-d* of FIG. 3 respectively.

The LEDs 701*a-d* are alternately driven by the positive and negative phases of the AC output signals and shifted signals, as illustrated in FIG. 4*b*, to alternately emit lights in the time domain. Due to the persistance of the human vision, when the frequency of the AC power signals is sufficiently high, for example, higher than 20 Hz, the discontinuoucy in the lights of different colors may becomes innoticeable in the human vision.

Figure 8:
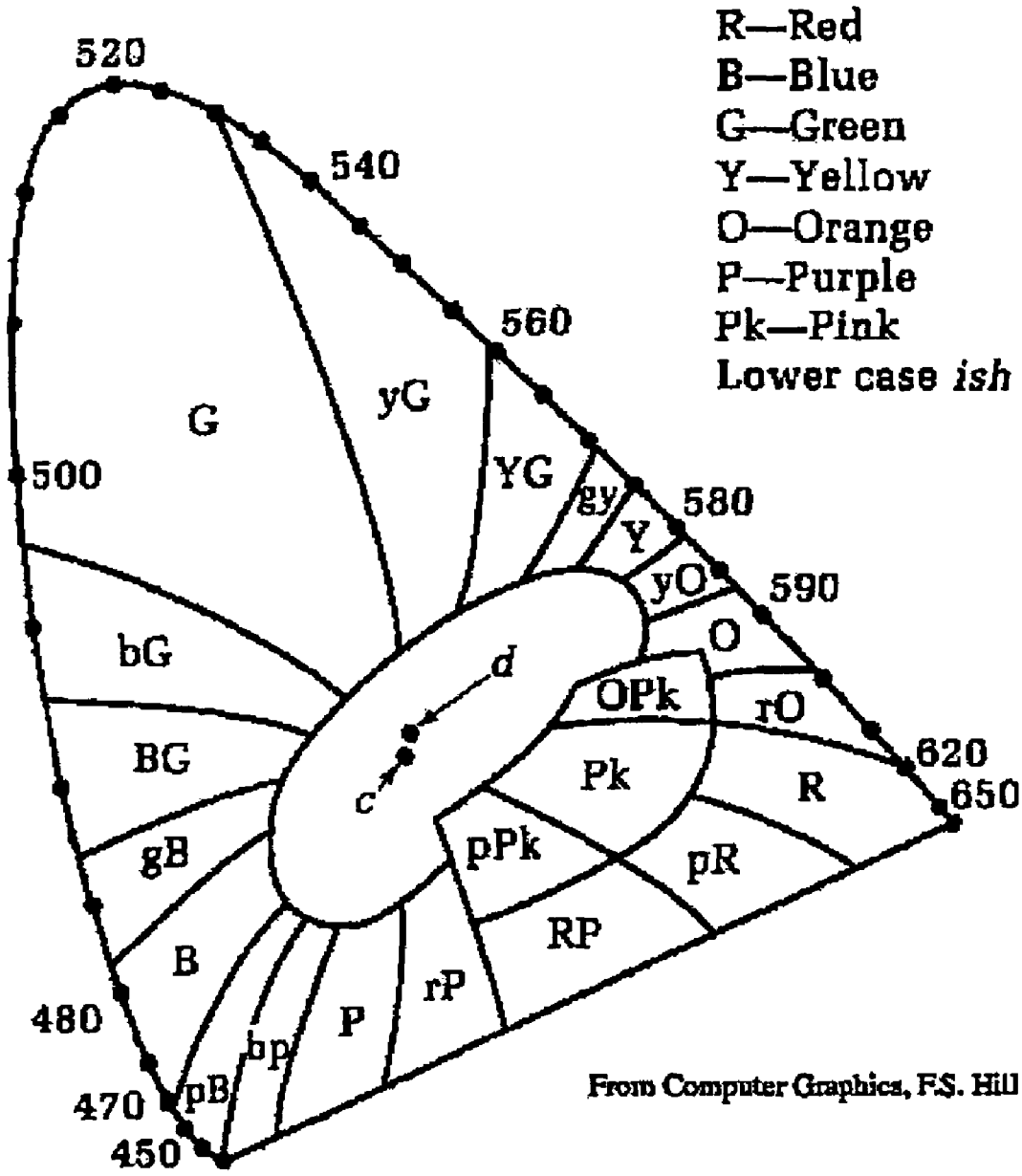
FIG. 8 illustrates a CIE color chart useful in the present invention.

In addition, the color of the output combination of lights of the light emitting device of FIG. 7 exhibited in the human vision can be determined in accordance with the CIE color chart as illustrated in FIG. 8, which is well known to the person skilled in the art. Control of the color of the output combination of lights can be achieved by, for example, controlling the voltage amplitude applied to any of the LEDs. This can be achieved by, for example, using respective adjustable resistors (not shown) connected to the LEDs as could be appreciated in the art.

Other alternatives can be made to the preceding described exemplary embodiment. For example, the transparent electrode layer, which assists improving current spreading, may not be necessary, especially in non-top-emitting LEDs.

Although the invention is illustrated and described herein as embodied, it is nevertheless not intended to be limited to the details described, since various modifications and structural changes may be made therein without departing from the spirit of the invention and within the scope and range of equivalents of the claims.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself. The definitions of the words or elements of the following claims are, therefore, defined in this specification to include not only the combination of elements which are literally set forth, but all equivalent structure, material or acts for performing substantially the same function in substantially the same way to obtain substantially the same result.

What is claimed is:

1. A light emitting device (LED), comprising:

a time delay mechanism in electrical connection with a power source for time shifting at least a portion of a power signal outputted by the power source; and a plurality of light emitting units formed by at least a light emitting diode (LED)structure, each light emitting unit being driven alternately and sequentially using the power source and the time delay mechanism;

the plurality of light emitting units being formed by a single LED, wherein the LED includes;

a top surface with a light emitting region, the top surface including a transparent or semi-transparent electrode layer;

a heterojunction within the device structure, the heterojunction comprising a p-type and an n-type semiconductor layer;

a plurality of electrodes positioned on the top surface, each being electrically connected to one of the p-type and n-type semiconductor layers, wherein at least a first and a second of the plurality of electrodes are connected to a same type semiconductor layer and are physically separated from each other;

at least a first and a second heterojunction within the heterojuntion, each being respectively defined between one of the first and second electrodes and one of the other electrodes connected to the other type semiconductor layer;

wherein each heterojunction region forms one of the light emitting units.

2. The light emitting device of claim 1, wherein the power source is an alternate current power source.

3. The light emitting device of claim 2, further comprising a rectifying circuit electrically connected between at least one light emitting unit from the plurality of light emitting units and one of the power source and the time delay mechanism.

4. The light emitting device of claim 1, wherein the time delay mechanism includes a phase shifter for shifting the phase of the power signal by a predetermined amount.

5. The light emitting device of claim 1, wherein the power source outputs a plurality of periodic discontinuous pulses.

6. The light emitting device of claim 1, wherein the output of the power source has a frequency of at least 20 Hz.

7. The light emitting device of claim 1, wherein the first and second electrodes are diametrically opposed.

8. The light emitting device of claim 1, wherein the first and second electrodes are located at the corners of the top surface.

9. The light emitting device of claim 1, wherein the electrode layer is made of a material selected from the group consisting of Indium Tin Oxide, Indium Zinc Oxide, and Zinc Oxide.

10. The light emitting device of claim 1, wherein each light emitting unit is formed by a single individual light emitting diode (LED) of a respective wavelength, wherein the plurality of LEDs are placed in close proximity to each other such that a combination of the lights emitted by each LED is generated after a mixing length from the plurality of LEDs, and whereby said combination of the lights of the first and second wavelengths exhibits a predetermined color in the human vision.

11. The light emitting device of claim 10, further comprising a control mechanism for controlling at least a character of one of the plurality of LEDS for altering the color of said combination of lights exhibited in the human vision.

12. The light emitting device of claim 11, wherein said control mechanism includes an adjustable resistor for controlling the voltage amplitude applied to the at least one of the plurality of LEDs.

13. The light emitting device of claim 11, wherein said control mechanism includes means for controlling the frequency of the power signals applied to the at least one of the plurality of LEDs.

14. The light emitting device of claim 10, wherein at least two of the LEDs emit lights of different wavelengths.

15. The light emitting device of claim 10, further comprising a phosphor materials coating at least one of the LEDs for altering the wavelength of its lights.

16. The light emitting device of claim 10, further comprising a diffuser for diffusing the lights of at least one of the plurality of LEDs so as to reduce said mixing length.

* * * * *